US008814662B1

(12) United States Patent
Lall et al.

(10) Patent No.: US 8,814,662 B1
(45) Date of Patent: Aug. 26, 2014

(54) VALUE ICON TO AWARD VIRTUAL CURRENCY IN A VIRTUAL GAME

(75) Inventors: Arjun Lall, San Francisco, CA (US); Abhinav Agrawal, San Francisco, CA (US); Jesse Hernandez, San Francisco, CA (US)

(73) Assignee: Zynga Inc., San Francisco, CA (US)

( * ) Notice: Subject to any disclaimer, the term of this patent is extended or adjusted under 35 U.S.C. 154(b) by 0 days.

(21) Appl. No.: 13/370,809

(22) Filed: Feb. 10, 2012

Related U.S. Application Data

(60) Provisional application No. 61/556,031, filed on Nov. 4, 2011.

(51) Int. Cl.
*G07F 17/32* (2006.01)

(52) U.S. Cl.
USPC ..... 463/25; 463/30; 463/37

(58) Field of Classification Search
None
See application file for complete search history.

(56) References Cited

U.S. PATENT DOCUMENTS

2006/0178202 A1* 8/2006 Hughes et al. ..... 463/20
2006/0287066 A1* 12/2006 Crawford et al. ..... 463/25
2008/0153586 A1* 6/2008 Gatto et al. ..... 463/25
2008/0188299 A1* 8/2008 Angell et al. ..... 463/29
2008/0226826 A1* 9/2008 Tanaka et al. ..... 427/299
2009/0118006 A1* 5/2009 Kelly et al. ..... 463/31
2009/0176558 A1* 7/2009 Englman et al. ..... 463/25
2010/0227675 A1* 9/2010 Luxton et al. ..... 463/25
2010/0292009 A1* 11/2010 Asami ..... 463/42

OTHER PUBLICATIONS

"Bond (finance) ", [Online]. Wikipedia.org, 2012 [retrieved on Jan. 19, 2012]. Retrieved from the Internet: <http://en.wikipedia.org/wiki/Bond_(finance)> 11 pgs.

* cited by examiner

*Primary Examiner* — Tramar Harper
(74) *Attorney, Agent, or Firm* — Schwegman Lundberg & Woessner, P.A.

(57) ABSTRACT

A computer-implemented method and system are described to provide virtual currency in a virtual game. The method may record a purchase value of a value icon in a virtual game. The value icon may then be deployed in the virtual environment of the virtual game. For each of a plurality of reference time periods, interaction of a player of the virtual game with the value icon may be monitored, and a virtual currency amount may be awarded to the player in the event of the player interacting with the value icon a set number of instances during each of the reference time periods. Further virtual currency may be denied upon subsequent interaction with the value icon during the same reference time period.

20 Claims, 11 Drawing Sheets

VALUE ICON TO AWARD VIRTUAL CURRENCY IN A VIRTUAL GAME

RELATED APPLICATIONS

This patent application claims the benefit of priority, under 35 U.S.C. Section 119(e), to U.S. Provisional Patent Application Ser. No. 61/556,031, entitled "VALUE ICON AND VIRTUAL CURRENCY REDEMPTION IN VIRTUAL GAME," filed on Nov. 4, 2011, which is incorporated by reference in its entirety.

FIELD

The present disclosure generally relates to awarding or redeeming virtual currency in a virtual game.

BACKGROUND

In typical game systems, a user or player may purchase virtual credits with real-world money. Users can earn virtual credits when the player achieves a certain experience level or complete a requested task in a game. Such virtual credits may be in the form of a virtual currency or virtual coins. The user can then use the virtual credits in future interactions with the game system.

BRIEF DESCRIPTION OF THE DRAWINGS

The present disclosure is illustrated by way of example, and not limitation, in the figures of the accompanying drawings, in which like reference numerals indicate similar elements unless otherwise indicated. In the drawings.

DESCRIPTION OF EXAMPLE EMBODIMENTS

Overview

Users of computer-implemented systems may use virtual currency to obtain or purchase a virtual object useable in a gaming networking system, to move to a higher level in a game, or to obtain any other benefit in the virtual world. In an example embodiment, a value icon is provided in a virtual game (e.g., in a virtual environment associated with a player of the virtual game). The value icon periodically (e.g., weekly) provides virtual currency to a player of the virtual game, provided that the user has interacted with the value icon during a set period (e.g., a week).

In an example embodiment, a method is provided that comprises recording a purchase value of a value icon in a virtual game and deploying the value icon in the virtual environment of the virtual game. For each of a plurality of reference time periods, the method may include monitoring an interaction of a player of the virtual game with the value icon, awarding a virtual currency amount to the player in the event of the player interacting with the value icon a set number of instances during each of the reference time periods, and denying the player further virtual currency upon subsequent interaction with the value icon during the same reference time period.

These and other example embodiments are described, by way of example, in further detail below.

Example System

Figure 1:
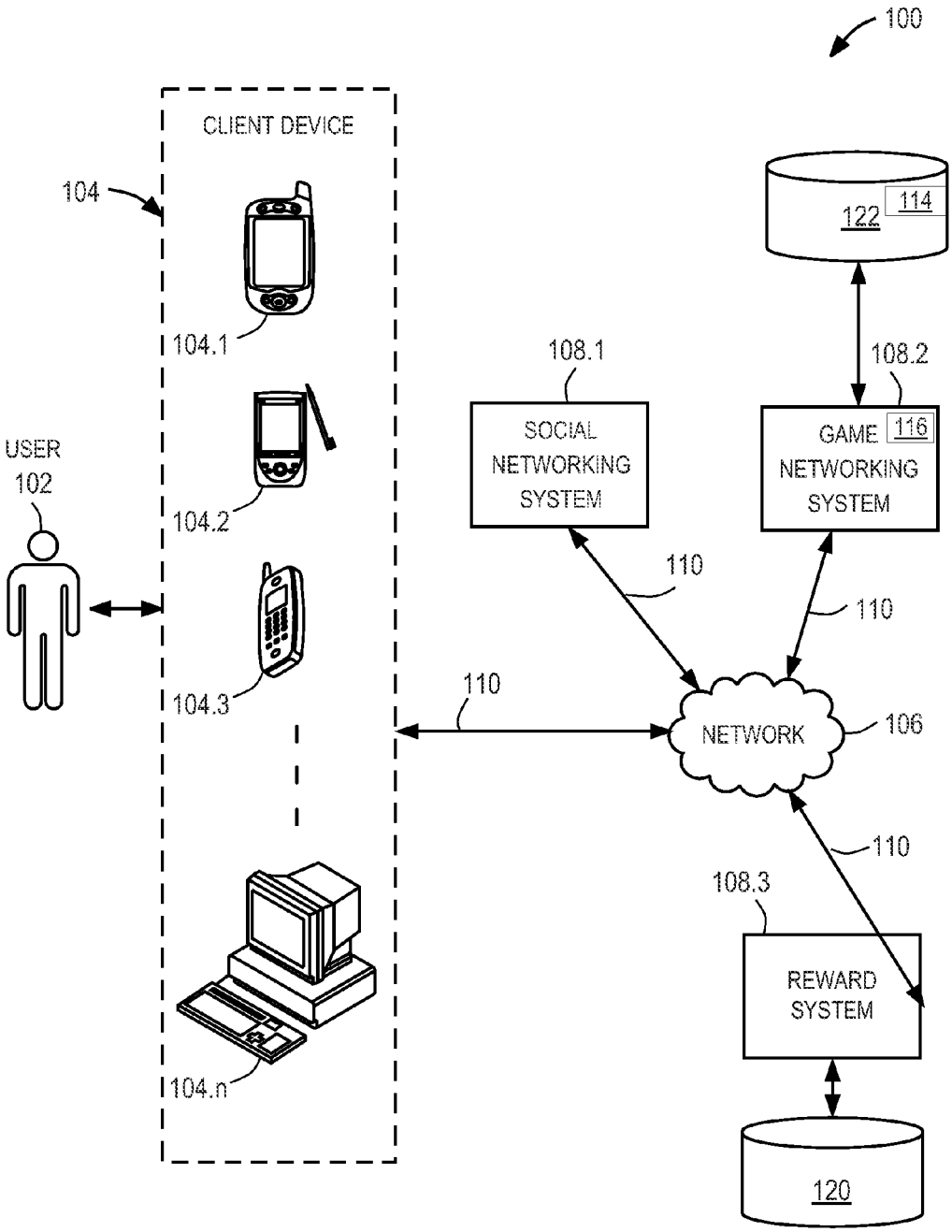
FIG. 1 shows a schematic diagram of a virtual gaming system, in accordance with an example embodiment, to award virtual currency to a player of a virtual game based on interaction with a value icon.

FIG. 1 shows a schematic diagram of a virtual gaming system 100, in accordance with an example embodiment, to award virtual currency to a player or user 102 of a virtual game based on interaction with a value icon. The system 100 may comprise a client device 104, a network 106, a social networking system 108.1, a game networking system 108.2, virtual value data 114, a virtual value manager 116, and an award/reward system 108.3. The example components of the system 100 may be connected directly or via the network 106, which may be any suitable network. In various example embodiments, one or more portions of the network 106 may include an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, any other type of network, or a combination of two or more such networks.

Although FIG. 1 illustrates a particular example of the arrangement of the user 102, the client device 104, the social networking system 108.1, the game networking system 108.2, the virtual value data 114, the virtual value manager 116, the reward system 108.3, and the network 106, this disclosure includes any suitable arrangement or configuration of the user 102, the client device 104, the social networking system 108.1, the game networking system 108.2, the virtual value data 114, the virtual value manager 116, the reward system 108.3, and the network 106.

The client device 104 may be any suitable computing device (e.g., devices 104.1-**104.*n*), such as a smart phone 104.1, a personal digital assistant 104.2, a mobile phone 104.3, a personal computer 104.*n*, a laptop, a computing tablet, or any other device suitable for playing a virtual game. The client device 104 may access the social networking system 108.1 or the game networking system 108.2 directly, via the network 106, or via a third-party system. For example, the client device 104 may access the game networking system 108.2 via the social networking system 108.1. The client device 104 may be any suitable computing device, such as a personal computer, laptop, cellular phone, smart phone, computing tablet, and the like. The client device 104 may further be capable of obtaining an image. For example, although not shown in FIG. 1**, the client device may include or be communicatively coupled to a camera.

The social networking system 108.1 may include a network-addressable computing system that can host one or more social graphs (see, for example, FIG. 7), and may be accessed by the other components of system 100 either directly or via the network 106. The social networking system 108.1 may generate, store, receive, and transmit social networking data.

Figure 2:
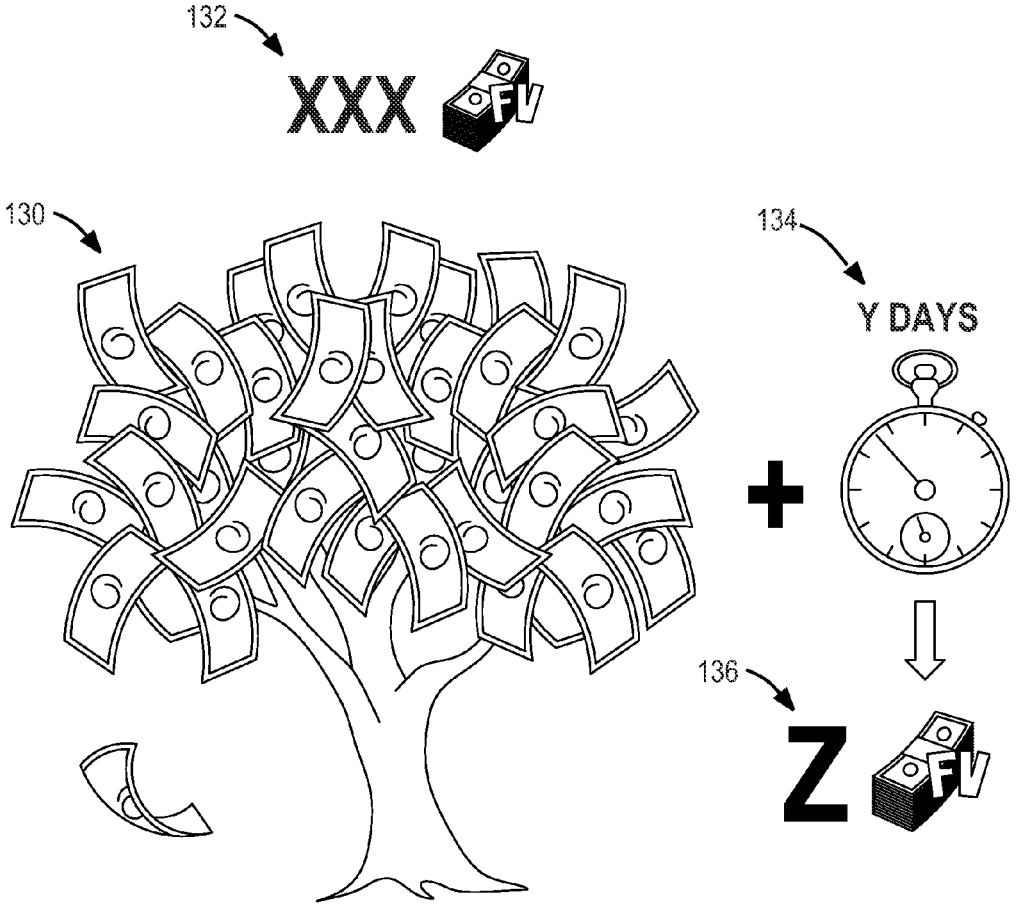
FIG. 2 shows an example value icon that periodically provides a player with virtual currency when the player interacts with the value icon.

FIG. 2 shows an example value icon 130 that periodically provides or awards a player with virtual currency when the player interacts with the value icon 130. The player may thus, for example, redeem virtual currency from the value icon 130. In an example embodiment, the player may purchase, within an online game, the value icon 130 (or a plurality on value icons 130) using a virtual currency and/or a real-world currency (see arrow 132). The value icon 130 is shown by way of example as a value tree. However, it is to be appreciated that the value icon may be an icon of a bank (e.g., depicting a physical building, person, or any other virtual object).

Thereafter, as shown by arrow 134, the player receives an award or credit, on a periodic basis (e.g., after set time periods such as a week, or any other set duration), in the form of virtual currency 136. However, in order for the player to receive the award, in an example embodiment, the player 102 is required to interact with the value icon 130 with predefined regularity. For example, a predefined amount of virtual currency (Z units of virtual currency) may be awarded to the player every Y days provided that the player interacts (e.g., plays the virtual game and interacts (e.g., via a mouse click) with the value icon 130 during the Y day period. It is, however, to be appreciated that various different value icons may be provided in different virtual games. As mentioned hereinbefore, the value icon 130 may be a tree (as shown in FIG. 2), a building, or any other virtual structure or object in a virtual game.

For example, the player 102 may be permitted to purchase 300 units of virtual currency (e.g., XXX=300), and upon each interaction of the player with the value icon 130 during the Y day period, the player may redeem or be awarded 10 units (e.g., Z=10) of virtual currency. In an example embodiment, when the Y time period corresponds to a week, the player would then redeem the full value of the initial purchase at week 30. In some example embodiments, the value icon may have a set or predetermined life span (for example, the value icon may expire). Accordingly, in an example embodiment, the value icon 130 may no longer provide virtual currency one year (or any other time period) after it has been purchased. In another example embodiment, the value icon 130 may provide virtual currency in perpetuity during each Y day period (or varying periods) in the event of the player periodically interacting with the value icon.

In an example embodiment, if the player fails to interact with the value icon 130 during anyone of the Y day periods, then the value icon 130 provides no award during that period. Accordingly, following the example provided above, the player would then redeem the full value of the initial purchase at week 31 (assuming only one interaction with the value icon was missed, at week 32 (assuming only two interactions with the value icon were missed), and so on. Accordingly, in an example embodiment, the player may redeem the full purchase (X units of virtual currency) sooner if the player consistently interacts with the value icon 130. Accordingly, a player may be encouraged to play an online virtual game regularly after purchasing the value icon 130.

In an example embodiment, the value icon 130 awards Z units of virtual currency in perpetuity provided that the player continues to interact with the value icon 130. It should be noted, in an example embodiment, that the value icon 130 provides the units of virtual currency in perpetuity even though the player does not necessarily interact with the value icon in every period of Y days. Further, it will be noted that the time during which the player is required to interact with the value icon 130 to receive a reward is not limited to a number of days. Accordingly, in other example embodiments, the time period during which the player is required to interact with the value icon 130 may be a given number of hours, weeks, months, or any other time period. Further, the amount of virtual currency or real-world currency required to acquire the value icon 130 may vary from one example embodiment to the next. Likewise, the units or amount of virtual currency awarded by the value icon 130 may vary from one embodiment to another. The virtual currency may have no value outside of the virtual game and not be transferable or resold. The upfront purchase of the virtual currency provides a player with future benefits for an upfront commitment.

Figure 3:
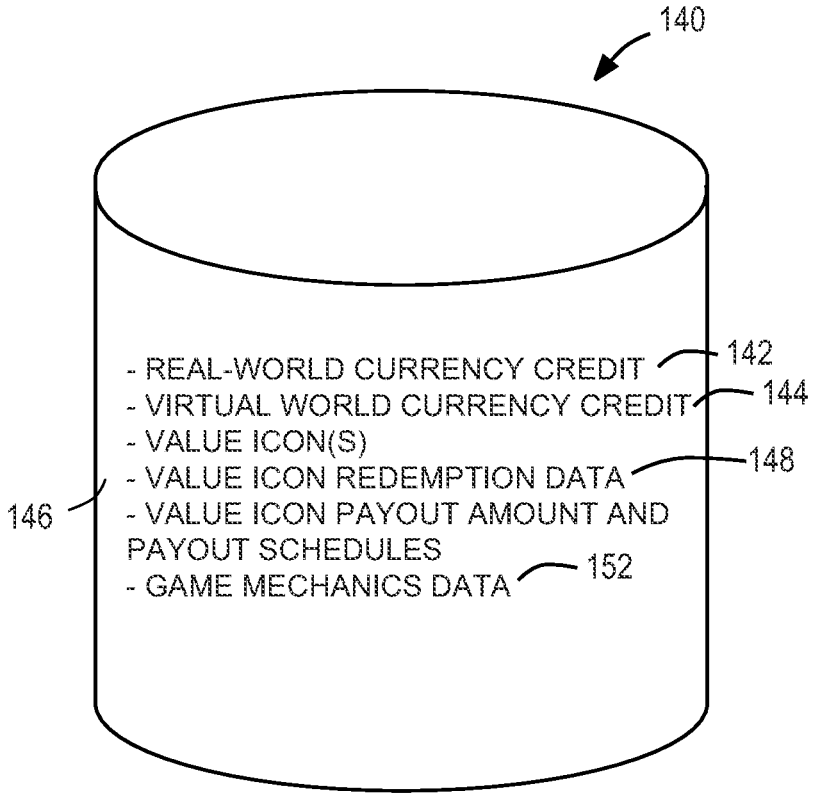
FIG. 3 shows value icon data, in accordance with an example embodiment, stored in a database of a virtual gaming system.

FIG. 3 shows value icon data stored in a database 140 of a virtual gaming system (e.g., the gaming system 100). The database 140 may correspond to a gaming database 122 or a reward database 120 of the system 100. Example information included in the database 140 is shown to include, but is not imited to, information on a real-world currency credit 142, information on virtual world currency credit 144 (e.g., XXX units), a list of value icons available 146 (e.g., a value tree, virtual structure (e.g., an icon representing a bank), and so on), identifiers linking the value icons 130 to one or more players, information on value icon redemption data 148, information on value icon payout or award amounts (e.g., awards of Z units made to date) and payout schedules 150 (e.g., award Z units of virtual currency every Y days), game mechanics data 152, and so on.

Figure 4:
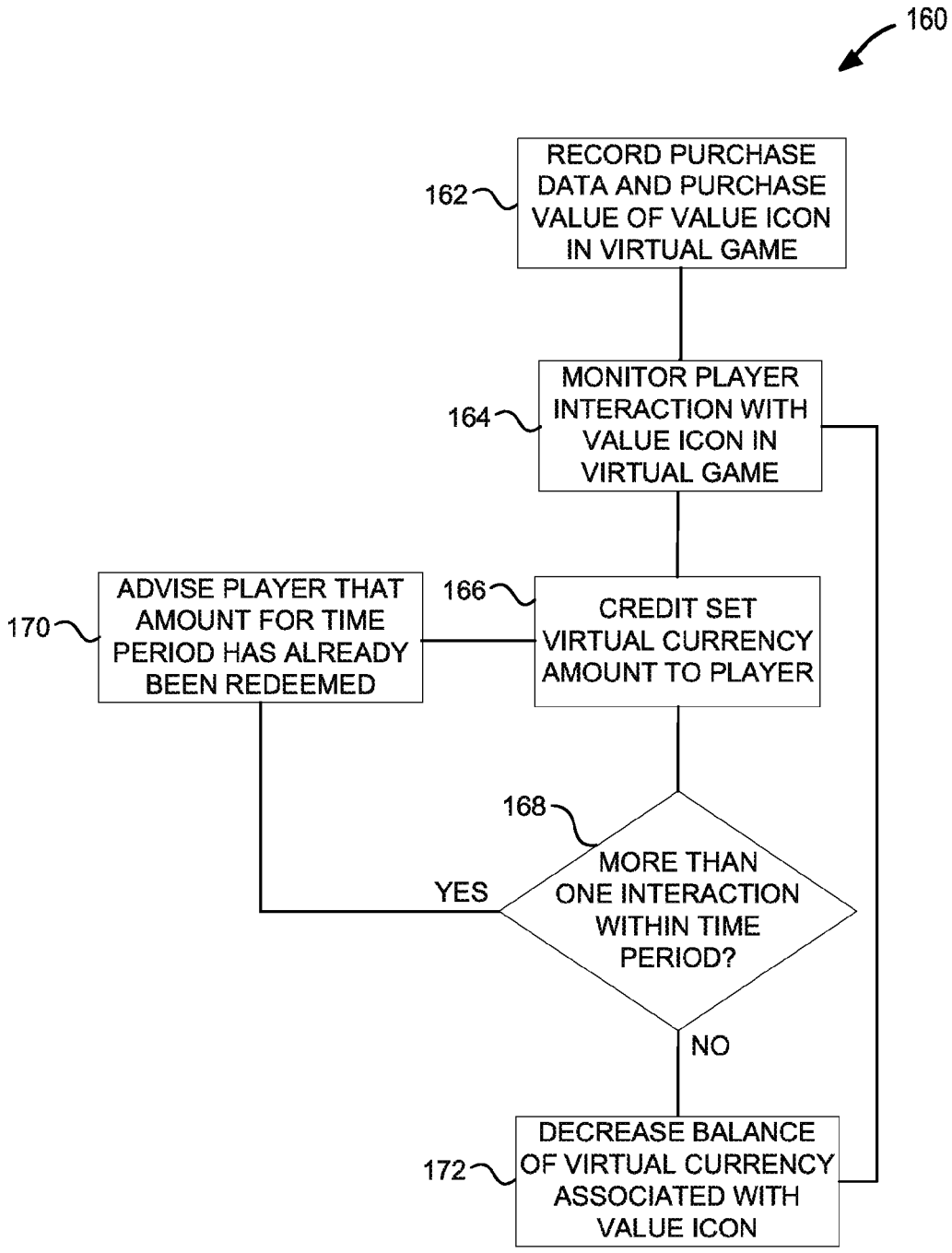
FIG. 4 shows a flowchart of a method, in accordance with an example embodiment, for periodically awarding virtual currency to a player in a virtual game based on interaction with a value icon.

FIG. 4 shows a flowchart of a method 160, in accordance with an example embodiment, for periodically (e.g., every Y days) awarding virtual currency (e.g., Z units) to a player in a virtual game based on player interaction with a value icon (e.g., the value icon 130) displayed in the game.

As shown at operation 162, the method 160 may record purchase data (e.g., an amount of real-world currency paid) and a purchase value (e.g., XXX units of virtual currency) of a value icon (e.g., the value icon 130) in a virtual game. Thereafter, as shown at operation 164, the method 160 may monitor player interaction (e.g., a clicking action using a mouse, interaction via a touch screen, or the like) with the virtual icon in the virtual game. In an example embodiment, the player interaction may include positioning or locating the value icon in the player's virtual environment of a virtual game. For example, when the value icon 130 is a tree, the player may position the value icon 130 in a virtual landscape of the virtual game where "planting" of a tree is authorized. As another example, when the value icon is a building structure depicting or resembling a bank, the player may position the value icon proximate virtual roads in a virtual city.

As shown at operation 166, units of virtual currency (e.g. Z units of virtual currency) may be awarded to the player in response to player interaction with the value icon. Thereafter, at decision operation 168, a determination is made if more than one interaction has taken place within a given time. If so, at operation 170, the method 160 then advises the player (e.g., via an in-game alert) that the virtual currency award for the particular time period has already been allocated or redeemed by the player for the given time period. The method 160 is then shown to return to operation 166. However, if a single interaction has taken place, the balance of the virtual currency associated with the player is then optionally decreased by the payout amount (e.g., by Z units) and awarded or credited to the player at operation 172. The method 160 may then return to operation 164.

Figure 5:
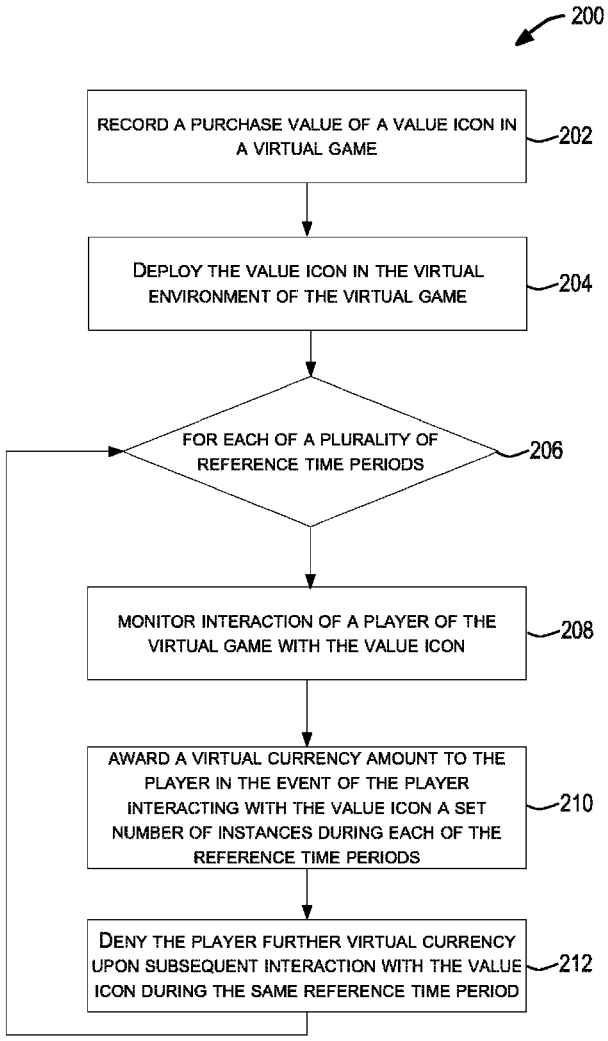
FIG. 5 shows a flowchart of a method, in accordance with another example embodiment, for periodically awarding virtual currency to a player in a virtual game based on interaction with a value icon.

FIG. 5 shows a flowchart of a method 200, in accordance with another example embodiment, for periodically awarding virtual currency amount (e.g., XXX units) to a player (e.g., the user or player 102) in a virtual game based on interaction with a value icon (e.g., the value icon 130). The method 200 may be deployed on any one of the systems described herein. For example, the method 200 may be deployed on the system 100 and, accordingly, is described merely by way of example with reference thereto.

As shown at operation 202, the method 200 may record a purchase value (e.g., XXX units) of a value icon (e.g., the value icon 130) in a virtual game. Thereafter, at operation 204, the method 200 may deploy the value icon 130 in the virtual environment of the virtual game. Thereafter, as shown at decision operation 206, for each of a plurality of reference time periods (e.g. weekly), interaction of a player of the virtual game with the value icon 130 may be monitored (see operation 208). During a given time period, a virtual currency amount (e.g., Z units) may be awarded or credited to the player 102 in the event of the player 102 interacting with the value icon 130 a set number of instances during each of the reference time periods (see operation 210). At operation 212, the method 200 denies (e.g., does not award or credit) the player 102 further virtual currency upon subsequent interaction with the value icon 130 during the same reference time period (e.g., further interactions after the set number of instances have already taken place). In some example embodiments, the set number of instances is a single award of the virtual currency amount during a reference time period.

It some example embodiments, the value icon depicts a tree or a bank building. The interaction with the value icon may be a mouse click, an interaction with a touch screen of a mobile device, a gesture, or any other input arrangement. In an example embodiment, the virtual currency amount is redeemable in the virtual game to acquire further virtual objects. The reference time period may be a multiple of a calendar day (for example, one calendar week). The virtual currency amount may be a set amount that is the same for each reference time period, different for at least two reference time periods, or different from reference period to reference period.

Figure 6:
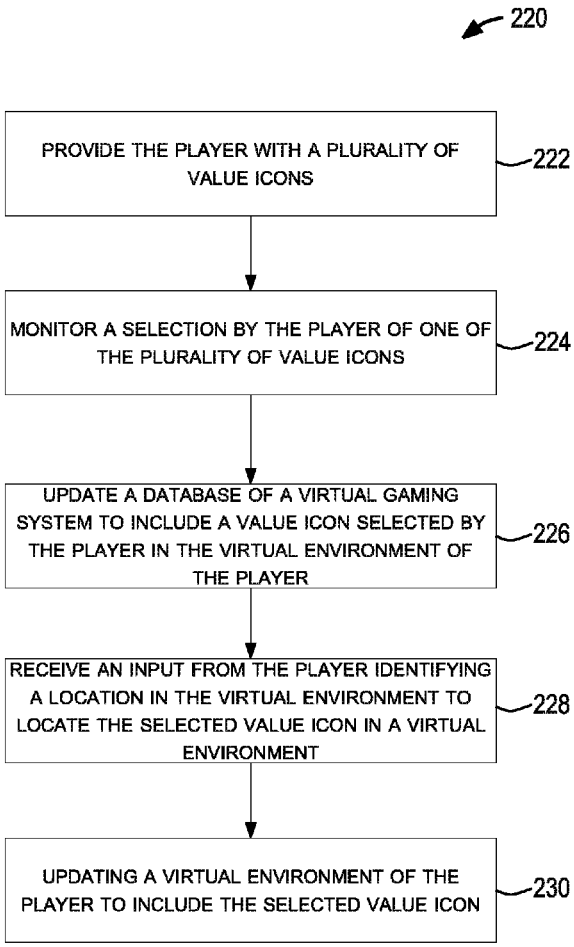
FIG. 6 shows a flowchart of a method, in accordance with an example embodiment, for defining a value icon in a virtual game environment.

In some example embodiments, the value icon (e.g. the value icon 130) can be positioned (e.g., uniquely) within a virtual game. FIG. 6 shows a flowchart of a method 220, in accordance with an example embodiment, for defining a value icon (e.g., value icon 130) in a virtual game environment and, optionally, positioning the value icon 130 within the virtual environment. As shown at operation 222, the method 220 may provide the player (e.g., the user or player 102) with a plurality of value icons (e.g., a value icon depicting a tree, a value icon depicting a bank building, or a value icon depicting any other physical object). As shown at operation 224, the method 220 monitors a selection by the player of one of the plurality of value icons and updates a database (e.g., the database 122) of a virtual gaming system (e.g., the system 100) to include the value icon selected by the player in the virtual environment of the player (see operation 226).

Optionally, in some example embodiments, the method 220 further comprises receiving an input from the player identifying a location in the virtual environment to locate the selected value icon in a virtual environment (see operation 228), and updates the virtual environment of the player to include the selected value icon (see operation 230).

In some example embodiments, an interaction count in a database (e.g., the database 120, the database 122, or any other database) is incremented each time the player interacts with the value icon during a reference time period. Thereafter, the interaction count may be compared with a reference count, and further awarding of the virtual currency amount may be denied (not awarded) for the reference time period based on the comparison. Thus, in an example embodiment, if the set number of instances is one interaction, and the reference time period is one week, the player will receive a virtual currency award in response to the first interaction (e.g., mouse click on the value icon). Subsequent interactions with the value icon during the particular week will not result in further awards being made. The system may cause a message to be displayed to the player in the event of the subsequent interaction (or interactions) by the player during the particular week. In an example embodiment, the systems and methods described herein may access time information of a locale of a player device and define the plurality of reference time periods based on the date and time information.

In an example embodiment, the virtual currency in not transferrable to another user or player in a social graph associated with the player who purchased the value icon.

Figure 7:
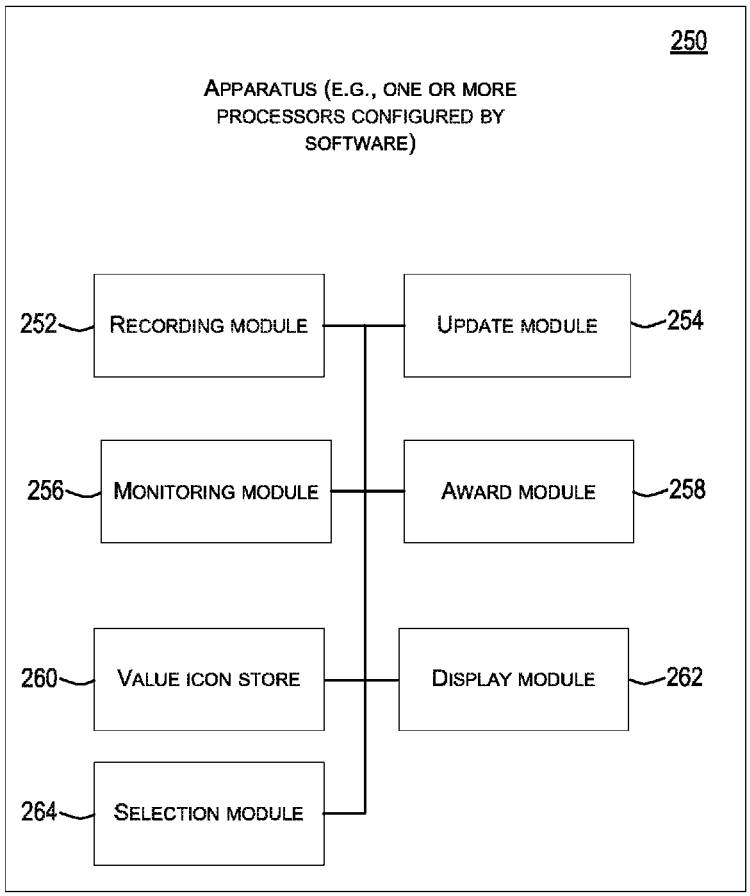
FIG. 7 shows a system, in accordance with an example embodiment, to periodically award virtual currency to a player in a virtual game based on interaction with a value icon.

FIG. 7 shows a system 250, in accordance with an example embodiment, to periodically award virtual currency to a player in a virtual game based on interaction with a value icon. The system 250 may at least in part perform the methods 200 or 220 and, accordingly, is described by way of example with reference thereto.

The system 250 is shown by way of example to include a recording module 252 to record a purchase value (e.g., XXX units) of a value icon (e.g., the value icon 130) in a virtual game. The recording of the purchase value may include updating a player account in a virtual gaming system, for example, that stores virtual currency owned by the player. Further, the system 250 is shown to include an update module 254 that may, inter alia, update the virtual environment of the virtual game to include the value icon. A monitoring module 256, implemented by at least one processor, is configured for each of a plurality of reference time periods, to monitor interaction of a player of the virtual game with the value icon.

An award module 258 may award a virtual currency amount to the player in the event of the player interacting with the value icon a set number of instances during each of the reference time periods. The award module 258 may deny the player further virtual currency upon subsequent interaction with the value icon during the same reference time period.

The system 250 may, optionally, provide the player with a plurality of different value icons (both in value and in the object they depict). Accordingly, a value icon store 260 may be provided that stores a plurality of value icons. A display module 262 may cause the display of the plurality of value icons (an icon depicting a currency tree, an icon depicting a bank building, and so on) and a selection module 264 may monitor a selection by the player of one of the plurality of value icons displayed. The update module 254 may then update the database of a virtual gaming system to include the value icon selected by the player in a virtual environment of the player.

The system 250 may receive an input from the player identifying a location in the virtual environment in which to locate the selected value icon, and a database storing a game instance for the player (e.g., the virtual environment of the player) is updated to include the selected value icon.

In an example embodiment, the system 250 increments an interaction count in a database each time the user interacts with the value icon during a reference time period. The interaction count may be compared with a reference count previously stored in the database, and further awarding of the virtual currency for the reference time period may be denied based on the comparison. For example, if only a single award is authorized during each week, the player will not be awarded further virtual currency when the interaction count reaches 2 in a particular week.

The modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein. One or more of the modules shown by way of example in FIG. 7 may be hardware modules.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, with a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Figure 8:
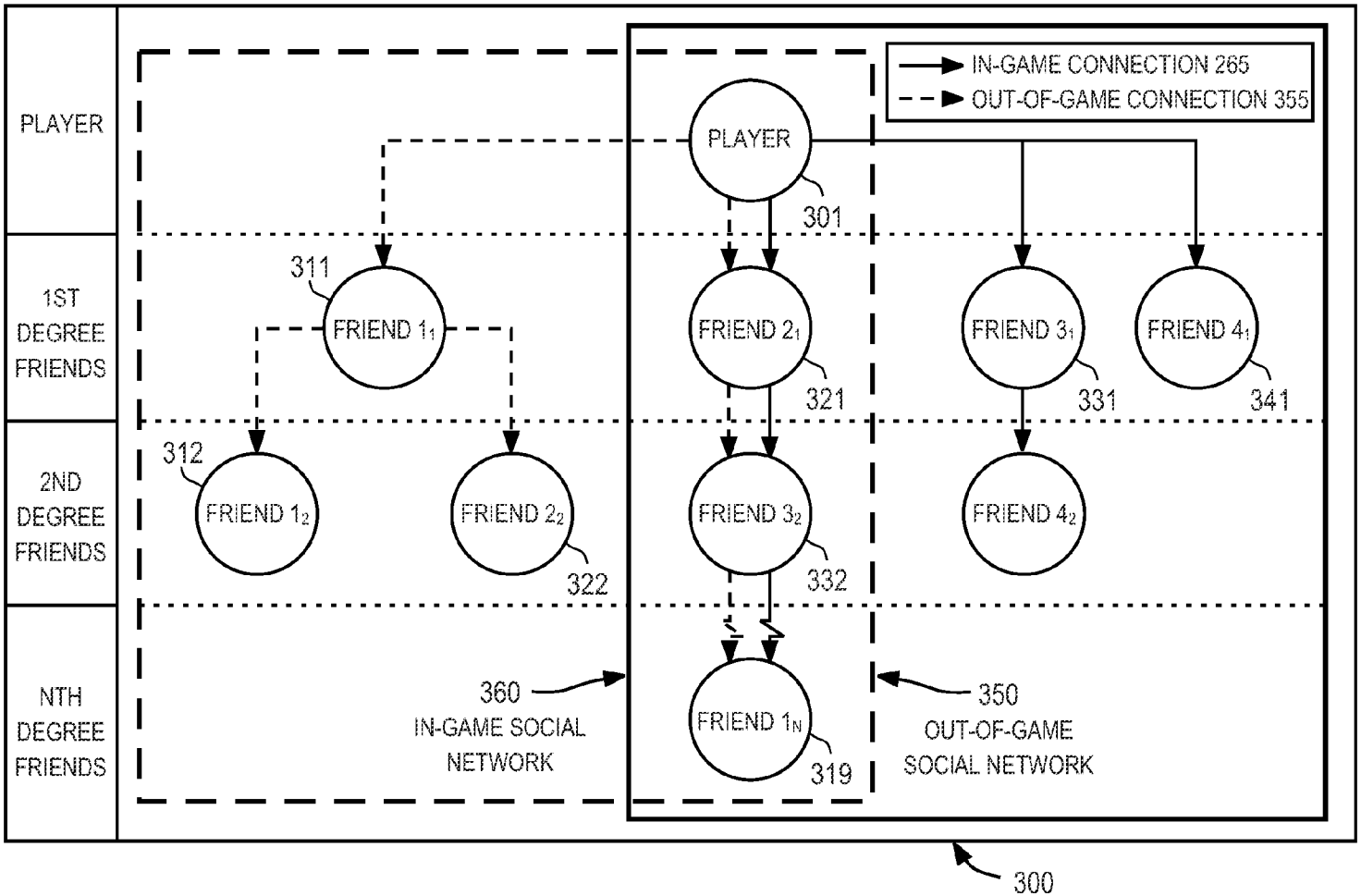
FIG. 8 shows a social network within a social graph, according to some example embodiments.

FIG. 8 shows an example of a social network within a social graph 300. In example embodiments, a virtual landscape or environment of a player may be visible to other players of the virtual game. Accordingly, in example embodiments, the value icon (e.g., the value icon 130) may be visible to other players in a virtual gaming or social network of the player purchasing the value icon.

The social graph 300 is shown by way of example to include an out-of-game social network 350 and an in-game social network 360. Moreover, the in-game social network 360 may include one or more users that are friends with the User 301 (e.g., a Friend 331), and may include one or more other users that are not friends with a Player 301. The social graph 300 may correspond to the various users associated with the virtual game. In an example embodiment, each user may "build" their own virtual structures using branded virtual objects and/or unbranded virtual objects. The virtual structures may include one or more value icons (e.g., the value icon 130). When, for example, the Player 301 visits the virtual environment of the Friend 331, the virtual environment displayed to the Player 301 includes objects (e.g., the value icon 130) selected and placed in that environment by the Friend 331. In an example embodiment, the user may build their own virtual structures using virtual currency provided by the virtual icon 130 shown in FIG. 2.

With reference back to FIG. 1, the game networking system 108.2 may include a network-addressable computing system (or systems) that can host one or more virtual games (for example, online games). The game networking system 108.2 may generate, store, receive, and transmit game-related data, such as, for example, game account data, game input, game state data, value icon data, and game displays. The game networking system 108.2 may be accessed by the other components of system 100 either directly or via the network 106. The user 102 may use the client device 104 to access, send data to, and receive data from the social networking system 108.1 and/or the game networking system 108.2.

The game networking system 108.2 may be communicatively coupled to the gaming database 122. The gaming database 122 may include data structures that define or otherwise characterize virtual objects (e.g., value icons) used in the virtual games hosted by the game networking system 108.2. In some embodiments, the virtual object store identifies the various virtual objects via a virtual object identifier. In this way, the game networking system 108.2 and/or the reward system 108.3 may specify a virtual object with a virtual object identifier. Furthermore, the gaming database 122 may link virtual objects (e.g., value icons) to user accounts. In this way, the game networking system 108.2 may allow a user (e.g., a player) to use the virtual objects linked to their user account. Virtual objects may be linked to a user based on a virtual object identifier. Accordingly, each value icon may have an associated virtual object identifier.

Moreover, the reward system 108.3 may be a network-addressable computing system that can host or facilitate automated awards of virtual objects usable in the game networking system 108.2. The reward system 108.3 may be accessed by the other components of system 100 either directly or via the network 106. The reward system 108.3 may award virtual currency in response to a player interacting with the value icon 130 within a given period (e.g., provide a set virtual currency award each week provided that the player interacts (e.g., clicks on, touches a zone on a touch screen or the like) the value icon 130 during the given period). In an example embodiment, the reward system 108.3 may perform the method 160 (see FIG. 4).

Example Game Systems, Social Networks, and Social Graphs

As described above, the example systems described herein may include, communicate, or otherwise interact with a game system. As such, a game system is now described to illustrate further example embodiments. In an online multiuser game, users control player characters (PCs), a game engine controls non-player characters (NPCs); the game engine also manages player character state and tracks states for currently active (e.g., online) users and currently inactive (e.g., offline) users. A game engine, in some embodiments, may include a documentation engine. Alternatively, the documentation engine and game engine may be embodied as separate components operated by the game network system and/or the document provision system.

A player character may have a set of attributes and a set of friends associated with the player character. As used herein, the terms "state" and "attribute" can be used interchangeably to refer to any in-game characteristic of a player character, such as location, assets (e.g., value icons), levels, condition, health, status, inventory, skill set, name, orientation, affiliation, specialty, and so on. The game engine may use a player character state to determine the outcome of a game event, while sometimes also considering set variables or random variables. Generally, an outcome is more favorable to a current player character (or player characters) when the player character has a better state. For example, a healthier player character is less likely to die in a particular encounter relative to a weaker player character or non-player character.

A game event may be an outcome of an engagement, a provision of access, rights, and/or benefits or the obtaining of some assets (e.g., health, money (e.g., virtual currency from a value icon), strength, inventory, land, etc.). A game engine may determine the outcome of a game event according to game rules (e.g., "a character with less than 5 health points will be prevented from initiating an attack"), based on a character's state, and also possibly on interactions of other player characters and a random calculation. Moreover, an engagement may include simple tasks (e.g. cross the river, shoot at an opponent, interact with a value icon, or the like), complex tasks (e.g., win a battle, unlock a puzzle, build a factory, rob a liquor store), or other events. The value icon 130 and the method 160 may, for example, be used by the player to enhance his or her game state.

In a game system according to some aspects of the present disclosure, in determining the outcome of a game event in a game being played by a user (or a group of more than one users), the game engine may take into account the state of the player character (or group of PCs) that is playing, but also the state of one or more PCs of offline/inactive users who are connected to the current user (or PC, or group of PCs) through the game social graph but are not necessarily involved in the game at the time.

For example, a User A with six friends on User A's team (e.g., the friends that are listed, depending on the nature of the game, as being in the user's mob/gang/set/army/business/crew/etc.) may be playing the virtual game and choose to confront a User B who has 20 friends on User B's team. In some embodiments, a user may only have first-degree friends on the user's team. In other embodiments, a user may also have second-degree and higher degree friends on the user's team. To resolve the game event, in some embodiments, the game engine may total up the weapon strength of the seven members of the User A's team and the weapon strength of the 21 members of the User B's team and decide an outcome of the confrontation based on a random variable applied to a probability distribution that favors the side with the greater total. In some embodiments, all of this may be done without any other current active participants other than the User A (e.g., the User A's friends, the User B, and the User B's friends could all be offline or inactive). In some embodiments, the friends in a user's team may see a change in their state as part of the outcome of the game event. In some embodiments, the state (assets, condition, level) of friends beyond the first degree are taken into account.

A virtual game may be hosted by the game networking system 108.2, which can be accessed using any suitable connection 110 with a suitable client device 104. A user may have a game account on the game networking system 108.2, wherein the game account may contain a variety of information associated with the user (e.g., the user's personal information, financial information, purchase history (e.g., of value icons), player character state, game state, etc.). In some embodiments, a user may play multiple games on the game networking system 108.2, which may maintain a single game account for the user with respect to the multiple games, or multiple individual game accounts for each game with respect to the user. In an example embodiment, virtual currency awarded by a value icon may be used across multiple games. In some embodiments, the game networking system 108.2 may assign a unique identifier to a user 102 of a virtual game hosted on the game networking system 108.2. The game networking system 108.2 may determine that the user 102 is accessing the virtual game by reading the user's cookies, which may be appended to HTTP requests transmitted by the client device 104, and/or by the user 102 logging onto the virtual game.

In some embodiments, the user 102 accesses a virtual game and controls the game's progress via the client device 104 (e.g., by inputting commands to the game at the client device 104). The client device 104 can display the game interface, receive inputs from the user 102, transmit user inputs or other events to the game engine, and receive instructions from the game engine. The game engine can be executed on any suitable system (such as, for example, the client device 104, the social networking system 108.1, or the game networking system 108.2). For example, the client device 104 may download client components of a virtual game, which are executed locally, while a remote game server, such as the game networking system 108.2, provides backend support for the client components and may be responsible for maintaining application data of the game, processing the inputs from the user 102, updating and/or synchronizing the game state based on the game logic and each input from the user 102, and transmitting instructions to the client device 104. As another example, when the user 102 provides an input to the game through the client device 104 (such as, for example, by typing on the keyboard, clicking the mouse, or interacting with a touch screen of the client device 104), the client components of the game may transmit the user's input to the game networking system 108.2.

In some embodiments, the user 102 accesses particular game instances of a virtual game. A game instance is a copy of a specific game play area that is created during runtime. In some embodiments, a game instance is a discrete game play area where one or more users 102 can interact in synchronous or asynchronous play. A game instance may be, for example, a level, zone, area, region, location, virtual space, or other suitable play area. A game instance may be populated by one or more in-game objects (e.g., the value icon 130). Each object may be defined within the game instance by one or more variables, such as, for example, position, height, width, depth, direction, time, duration, speed, color, and other suitable variables.

In some embodiments, a specific game instance may be associated with one or more specific users. A game instance is associated with a specific user when one or more game parameters of the game instance are associated with the specific user. For example, a game instance associated with a first user may be named "First User's Play Area." This game instance may be populated with the first user's PC and one or more in-game objects associated with the first user.

In some embodiments, a game instance associated with a specific user is only accessible by that specific user. For example, a first user may access a first game instance when playing a virtual game, and this first game instance may be inaccessible to all other users. In other embodiments, a game instance associated with a specific user is accessible by one or more other users, either synchronously or asynchronously with the specific user's game play. For example, a first user may be associated with a first game instance, but the first game instance may be accessed by all first-degree friends in the first user's social network.

In some embodiments, the set of in-game actions available to a specific user is different in a game instance that is associated with this user compared to a game instance that is not associated with this user. The set of in-game actions available to a specific user in a game instance associated with this user may be a subset, superset, or independent of the set of in-game actions available to this user in a game instance that is not associated with him. For example, a first user may be associated with Blackacre Farm in an online farming game and may be able to plant crops on Blackacre Farm. If the first user accesses a game instance associated with another user, such as Whiteacre Farm, the game engine may not allow the first user to plant crops in that game instance. However, other in-game actions may be available to the first user, such as watering or fertilizing crops on Whiteacre Farm. Likewise, a value icons may have restrictions.

In some embodiments, a game engine interfaces with a social graph. Social graphs are models of connections between entities (e.g., individuals, users, contacts, friends, users, player characters, non-player characters, businesses, groups, associations, concepts, etc.). These entities are considered "users" of the social graph; as such, the terms "entity" and "user" may be used interchangeably when referring to social graphs herein. A social graph can have a node for each entity and edges to represent relationships between entities. A node in a social graph can represent any entity. In some embodiments, a unique client identifier may be assigned to individual users in the social graph. This disclosure assumes that at least one entity of a social graph is a user or player character in an online multiuser game.

In some embodiments, the social graph is managed by the game networking system 108.2, which is managed by the game operator. In other embodiments, the social graph is part of a social networking system 108.1 managed by a third party (e.g., Facebook, Friendster, Myspace). In yet other embodiments, the user 102 has a social network on both the game networking system 108.2 and the social networking system 108.1, wherein the user 102 can have a social network on the game networking system 108.2 that is a subset, superset, or independent of the user's social network on the social networking system 108.1. In such combined systems, game network system 108.2 can maintain social graph information with edge-type attributes that indicate whether a given friend is an "in-game friend," an "out-of-game friend," or both. The various embodiments disclosed herein are operable when the social graph is managed by the social networking system 108.1, the game networking system 108.2, or both.

Example Systems and Methods

Returning to FIG. 8, the User 301 may be associated, connected, or linked to various other users, or "friends," within the out-of-game social network 350. These associations, connections, or links can track relationships between users within the out-of-game social network 350 and are commonly referred to as online "friends" or "friendships" between users. Each friend or friendship in a particular user's social network within a social graph is commonly referred to as a "node." For purposes of illustration, the details of out-of-game social network 350 are described in relation to User 301. As used herein, the terms "user" and "player" can be used interchangeably and can refer to any user in an online multiuser game system or social networking system. As used herein, the term "friend" can mean any node within a user's social network.

As shown in FIG. 8, User 301 has direct connections with several friends. When the User 301 has a direct connection with another individual, that connection is referred to as a first-degree friend. In out-of-game social network 350, the User 301 has two first-degree friends. That is, the User 301 is directly connected to Friend $\mathbf{1}_1$ 311 and Friend $\mathbf{2}_1$ 321. In social graph 300, it is possible for individuals to be connected to other individuals through their first-degree friends (e.g., friends of friends). As described above, the number of edges in a minimum path that connects a user to another user is considered the degree of separation. For example, FIG. 8 shows that User 301 has three second-degree friends to which User 301 is connected via User 301's connection to User 301's first-degree friends. Second-degree Friend $\mathbf{1}_2$ 312 and Friend $\mathbf{2}_2$ 322 are connected to User 301 via User 301's first-degree Friend $\mathbf{1}_1$ 311. The limit on the depth of friend connections, or the number of degrees of separation for associations, that User 301 is allowed is typically dictated by the restrictions and policies implemented by the social networking system 108.1.

In various embodiments, User 301 can have Nth-degree friends connected to him through a chain of intermediary degree friends as indicated in FIG. 8. For example, Nth-degree Friend IN 319 is connected to User 301 within in-game social network 360 via second-degree Friend $\mathbf{3}_2$ 332 and one or more other higher-degree friends.

In some embodiments, a user (or player character) has a social graph within an online multiuser game that is maintained by the game engine and another social graph maintained by a separate social networking system. FIG. 8 depicts an example of in-game social network 360 and out-of-game social network 350. In this example, User 301 has out-of-game connections 355 to a plurality of friends, forming out-of-game social network 350. Here. Friend $\mathbf{1}_1$ 311 and Friend $\mathbf{2}_1$ 321 are first-degree friends with User 301 in User 301's out-of-game social network 350. User 301 also has in-game connections 365 to a plurality of users, forming in-game social network 360. Here, Friend $\mathbf{2}_1$ 321, Friend $\mathbf{3}_1$ 331, and Friend $\mathbf{4}_1$ 341 are first-degree friends with User 301 in User 301's in-game social network 360. In some embodiments, a game engine can access in-game social network 360, out-of-game social network 350, or both.

In some embodiments, the connections in a user's in-game social network are formed both explicitly (e.g., when users "friend" each other) and implicitly (e.g., when the system observes user behaviors and "friends" users to each other). Unless otherwise indicated, reference to a friend connection between two or more users can be interpreted to cover both explicit and implicit connections, using one or more social graphs and other factors to infer friend connections. The friend connections can be unidirectional or bidirectional. It is also not a limitation of this description that two users who are deemed "friends" for the purposes of this disclosure are not friends in real life (e.g., in disintermediated interactions or the like), but that could be the case.

Figure 9:
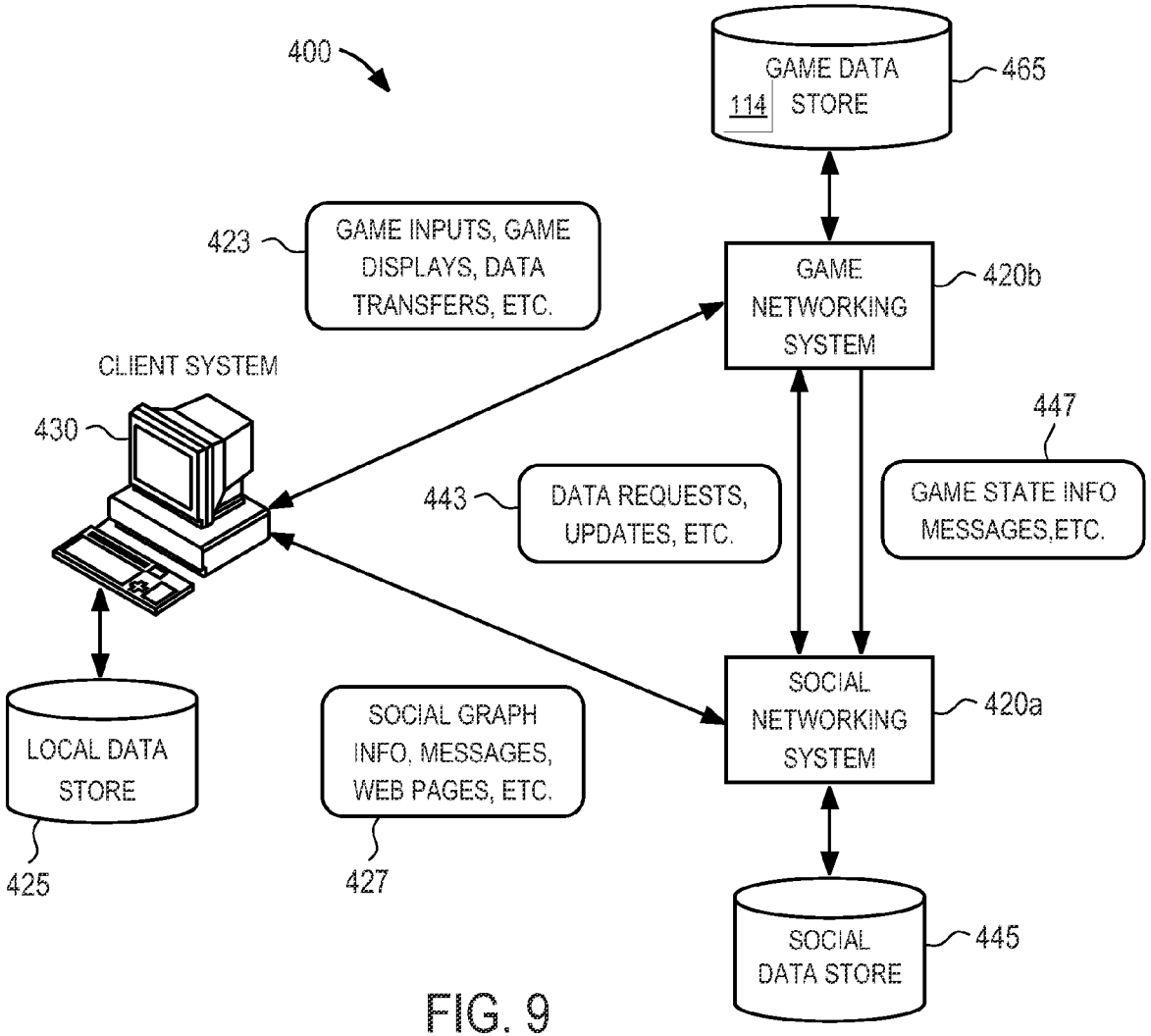
FIG. 9 illustrates data flow between example components of the example system of FIG. 1, according to some example embodiments.

FIG. 9 illustrates an example data flow between example components of an example system 400. One or more of the components of the example system 400 may correspond to one or more of the components of the example system 100. In some embodiments, system 400 includes a client system 430, a social networking system 420*a*, and a game networking system 420*b*. The components of system 400 can be connected to each other in any suitable configuration, using any suitable type of connection. The components may be connected directly or over any suitable network. The client system 430, the social networking system 420*a*, and the game networking system 420*b* may have one or more corresponding data stores, such as the local data store 425, the social data store 445, and the game data store 465, respectively.

The client system 430 may receive and transmit data 423 to and from the game networking system 420*b*. This data can include, for example, a web page, a message, a game input, a game display, a HTTP packet, a data request, transaction information, and other suitable data. At some other time, or at the same time, the game networking system 420*b* may communicate data 443, 447 (e.g., game state information, game system account information, page info, messages, data requests, updates, etc.) with other networking systems, such as the social networking system 420*a* (e.g., Facebook, Myspace, etc.). The client system 430 can also receive and transmit data 427 to and from the social networking system 420*a*. This data can include, for example, web pages, messages, social graph information, social network displays, HTTP packets, data requests, transaction information, updates, and other suitable data.

Communication between the client system 430, the social networking system 420*a*, and the game networking system 420*b* can occur over any appropriate electronic communication medium or network using any suitable communication protocol. For example, the client system 430, as well as various servers of the systems described herein, may include Transport Control Protocol/Internet Protocol (TCP/IP) networking stacks to provide for datagram and transport functions. Of course, any other suitable network and transport layer protocols can be utilized.

In some embodiments, an instance of a virtual game is stored as a set of game state parameters that characterize the state of various in-game objects, such as, for example, player character state parameters, non-player character parameters, and virtual item parameters. In some embodiments, game state is maintained in a database as a serialized, unstructured string of text data as a so-called Binary Large Object (BLOB). When a user accesses a virtual game on the game networking system 420*b*, the BLOB containing the game state for the instance corresponding to the user may be transmitted to the client system 430 for use by a client-side executed object to process. In some embodiments, the client-side executable is a FLASH-based game, which can de-serialize the game state data in the BLOB. As a user plays the game, the game logic implemented at the client system 430 maintains and modifies the various game state parameters locally. The client-side game logic may also batch game events, such as mouse clicks, and transmit these events to the game networking system 420*b*. Game networking system 420*b* may itself operate by retrieving a copy of the BLOB from a database or an intermediate memory cache (memcache) layer. The game networking system 420*b* can also de-serialize the BLOB to resolve the game state parameters and execute its own game logic based on the events in the batch file of events transmitted by the client to synchronize the game state on the server side. The game networking system 420*b* may then re-serialize the game state, now modified into a BLOB, and pass this to a memory cache layer for lazy updates to a persistent database.

In some embodiments, a computer-implemented game is a text-based or turn-based game implemented as a series of web pages that are generated after a user selects one or more actions to perform. The web pages may be displayed in a browser client executed on the client system 430. For example, a client application downloaded to the client system 430 may operate to serve a set of web pages to a user. As another example, a virtual game may be an animated or rendered game executable as a stand-alone application or within the context of a webpage or other structured document. In some embodiments, the virtual game is implemented using Adobe Flash-based technologies. As an example, a game may be fully or partially implemented as a SWF object that is embedded in a web page and executable by a Flash media user plug-in. In some embodiments, one or more described web pages are associated with or accessed by the social networking system 420*a*. This disclosure contemplates using any suitable application for the retrieval and rendering of structured documents hosted by any suitable network-addressable resource or website.

Application event data of a game is any data relevant to the game (e.g., user inputs or interations). In some embodiments, each application datum may have a name and a value, and the value of the application datum may change (e.g., be updated) at any time. When an update to an application datum occurs at the client system 430, either caused by an action of a game user or by the game logic itself, the client system 430 may need to inform the game networking system 420*b* of the update. For example, if the game is a farming game with a harvest mechanic (such as Zynga FarmVille), an event can correspond to a user clicking on a parcel of land to harvest a crop. In such an instance, the application event data may identify an event or action (e.g., harvest, payment of virtual currency from a virtual icon, or the like) and an object in the game to which the event or action applies.

In some embodiments, one or more objects of a game are represented as an Adobe Flash object. Flash may manipulate vector and raster graphics, and supports bidirectional streaming of audio and video. "Flash" may mean the authoring environment, the user, or the application files. In some embodiments, the client system 430 may include a Flash client. The Flash client may be configured to receive and run a Flash application or game object code from any suitable networking system (such as, for example, the social networking system 420*a* or the game networking system 420*b*). In some embodiments, the Flash client is run in a browser client executed on the client system 430. A user can interact with Flash objects using the client system 430 and the Flash client. The Flash objects can represent a variety of in-game objects. Thus, the user may perform various in-game actions on various in-game objects by making various changes and updates to the associated Flash objects.

In some embodiments, in-game actions are initiated by clicking or similarly interacting with a Flash object that represents a particular in-game object. For example, a user can interact with a Flash object to use, move, rotate, delete, attack, shoot, redeem virtual currency from a value object, or harvest an in-game object. This disclosure contemplates performing any suitable in-game action by interacting with any suitable Flash object. In some embodiments, when the user makes a change to a Flash object representing an in-game object, the client-executed game logic may update one or more game state parameters associated with the in-game object. To ensure synchronization between the Flash object shown to the user at the client system 430, the Flash client may send the events that caused the game state changes to the in-game object to the game networking system 420*b*. However, to expedite the processing and, hence, the speed of the overall gaming experience, the Flash client may collect a batch of some number of events or updates into a batch file. The number of events or updates may be determined by the Flash client dynamically or determined by the game networking system 420*b* based on server loads or other factors. For example, client system 430 may send a batch file to the game networking system 420*b* whenever 50 updates have been collected or after a threshold period of time, such as every minute.

As used herein, the term "application event data" may refer to any data relevant to a computer-implemented virtual game application that may affect one or more game state parameters, including, for example and without limitation, changes to user data or metadata, changes to user social connections or contacts, user inputs to the game, and events generated by the game logic. In some embodiments, each application datum has a name and a value. The value of an application datum may change at any time in response to the game play of a user or in response to the game engine (e.g., based on the game logic). In some embodiments, an application data update occurs when the value of a specific application datum is changed.

In some embodiments, when a user plays a virtual game on the client system 430, the game networking system 420*b* serializes all the game-related data, including, for example and without limitation, game states, game events, user inputs, for this particular user and this particular game into a BLOB and may store the BLOB in a database. The BLOB may be associated with an identifier that indicates that the BLOB contains the serialized game-related data for a particular user and a particular virtual game. In some embodiments, while a user is not playing the virtual game, the corresponding BLOB may be stored in the database. This enables a user to stop playing the game at any time without losing the current state of the game the user is in. When a user resumes playing the game next time, game networking system 420*b* may retrieve the corresponding BLOB from the database to determine the most-recent values of the game-related data. In some embodiments, while a user is playing the virtual game, the game networking system 420*b* also loads the corresponding BLOB into a memory cache so that the game system may have faster access to the BLOB and the game-related data contained therein.

Figure 10:
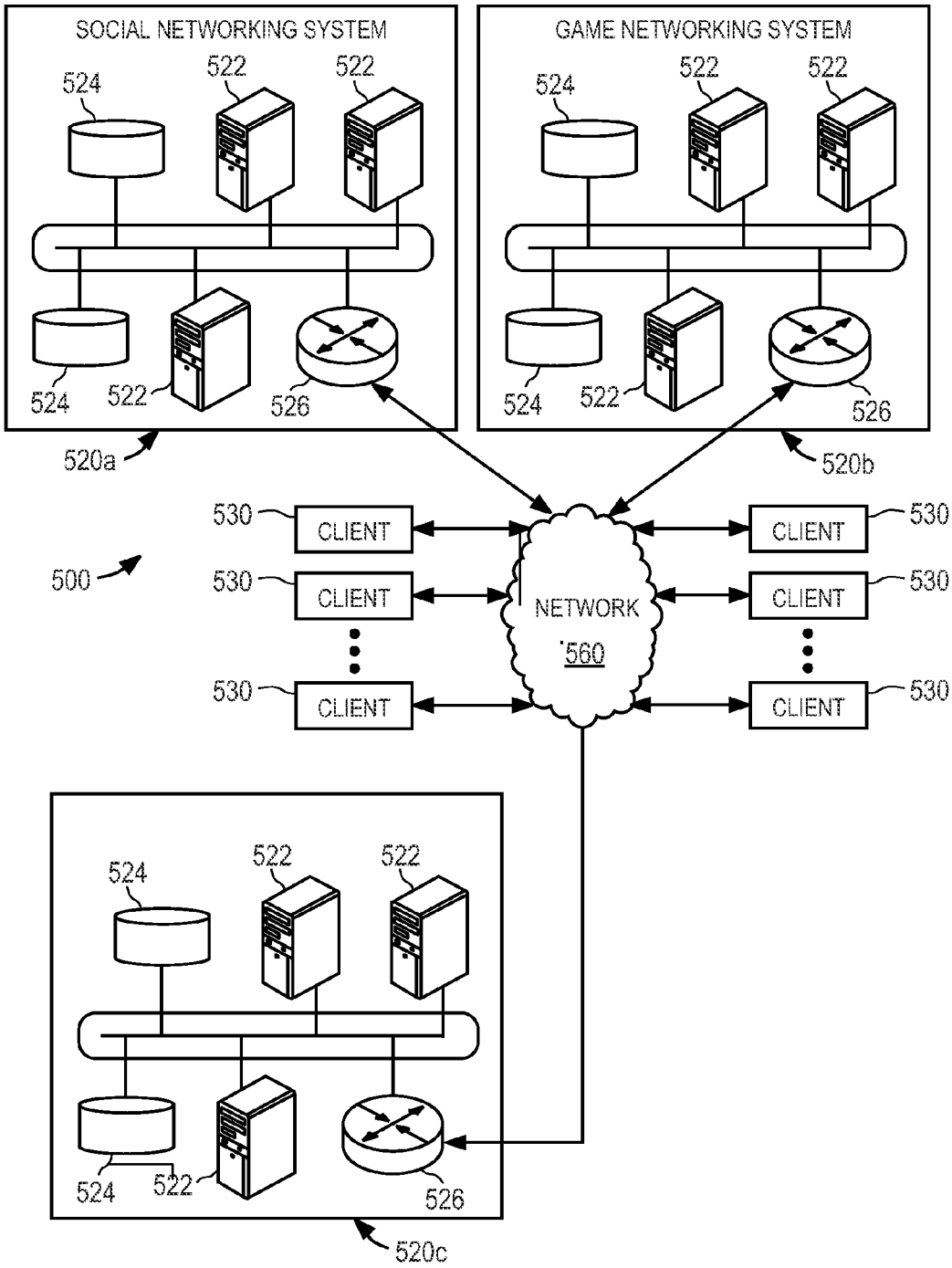
FIG. 10 illustrates an example network environment in which various example embodiments may operate.

Various embodiments may operate in a WAN environment, such as the Internet, including multiple network addressable systems. FIG. 10 illustrates an example network environment 500, in which various example embodiments may operate. A network cloud 560 generally represents one or more interconnected networks, over which the systems and hosts described herein can communicate. Network cloud 560 may include packet-based WANs (such as the Internet), private networks, wireless networks, satellite networks, cellular networks, paging networks, and the like. As FIG. 10 illustrates, various embodiments may operate in a network environment 500 comprising one or more networking systems, such as a social networking system 520*a*, a game networking system 520*b*, a reward system 520*c*, and one or more client systems 530. The components of the social networking system 520*a*, the game networking system 520*b*. and reward system 520*c* operate analogously; as such, hereinafter they may be referred to simply as the networking system 520. The client systems 530 are operably connected to the network cloud 560 via a network service provider, a wireless carrier, or any other suitable means.

The networking system 520 is a network addressable system that, in various example embodiments, comprises one or more physical servers 522 and data stores 524. The one or more physical servers 522 are operably connected to computer network cloud 560 via, by way of example, a set of routers and/or networking switches 526. In an example embodiment, the functionality hosted by the one or more physical servers 522 may include web or HTTP servers, FTP servers, as well as, without limitation, webpages and applications implemented using Common Gateway Interface (CGI) script, PHP Hyper-text Preprocessor (PHP), Active Server Pages (ASP), Hyper-Text Markup Language (HTML), Extensible Markup Language (XML), Java, JavaScript, Asynchronous JavaScript and XML (AJAX), Flash, ActionScript, and the like.

The physical servers 522 may host functionality directed to the operations of the networking system 520. Hereinafter servers 522 may be referred to as server 522, although the server 522 may include numerous servers hosting, for example, the networking system 520, as well as other content distribution servers, data stores, and databases. Data store 524 may store content and data relating to, and enabling operation of, the networking system 520 as digital data objects. A data object, in some embodiments, is an item of digital information typically stored or embodied in a data file, database, or record. Content objects may take many forms, including: text (e.g., ASCII, SGML, HTML), images (e.g., jpeg, tif and gif), graphics (vector-based or bitmap), audio, video (e.g., mpeg), or other multimedia, and combinations thereof. Content object data may also include executable code objects (e.g., games executable within a browser window or frame), podcasts, and the like.

Logically, data store 524 corresponds to one or more of a variety of separate and integrated databases, such as relational databases and object-oriented databases, that maintain information as an integrated collection of logically related records or files stored on one or more physical systems. Structurally, data store 524 may generally include one or more of a large class of data storage and management systems. In some embodiments, data store 524 may be implemented by any suitable physical system(s) including components, such as one or more database servers, mass storage media, media library systems, storage area networks, data storage clouds, and the like. In one example embodiment, data store 524 includes one or more servers, databases (e.g., MySQL), and/or data warehouses. Data store 524 may include data associated with different networking system 520 users and/or client systems 530.

The client system 530 is generally a computer or computing device including functionality for communicating (e.g., remotely) over a computer network. The client system 530 may be a desktop computer, laptop computer, personal digital assistant (PDA), in- or out-of-car navigation system, smart phone or other cellular or mobile phone, or mobile gaming device, among other suitable computing devices. Client system 530 may execute one or more client applications, such as a Web browser.

When a user at a client system 530 desires to view a particular webpage (hereinafter also referred to as target structured document) hosted by the networking system 520, the user's web browser, or other document rendering engine or suitable client application, formulates and transmits a request to the networking system 520. The request generally includes a URL or other document identifier as well as metadata or other information. By way of example, the request may include information identifying the user, a timestamp identifying when the request was transmitted, and/or location information identifying a geographic location of the user's client system 530 or a logical network location of the user's client system 530.

Although the example network environment 500 described above and illustrated in FIG. 10 is described with respect to the social networking system 520*a* and the game networking system 520*b*, this disclosure encompasses any suitable network environment using any suitable systems. For example, a network environment may include online media systems, online reviewing systems, online search engines, online advertising systems, or any combination of two or more such systems.

Figure 11:
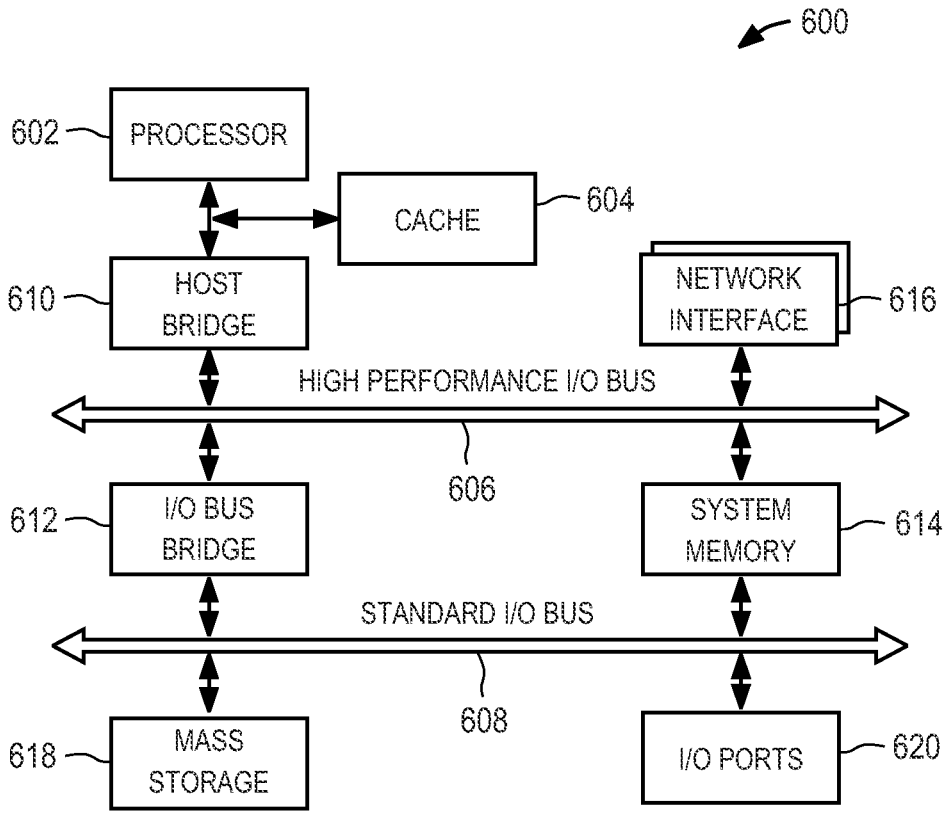
FIG. 11 illustrates an example computing system architecture, which may be used to implement one or more of the methodologies described herein.

FIG. 11 illustrates an example computing system architecture, which may be used to implement a server 522 or a client system 530. In one embodiment, the hardware system 600 comprises a processor 602, a cache memory 604, and one or more executable modules and drivers, stored on a tangible computer-readable storage medium, directed to the functions described herein. Additionally, the hardware system 600 may include a high performance input/output (I/O) bus 606 and a standard I/O bus 608. A host bridge 610 may couple the processor 602 to the high performance I/O bus 606, whereas the I/O bus bridge 612 couples the two buses 606 and 608 to each other. A system memory 614 and one or more network/communication interfaces 616 may couple to the bus 606. The hardware system 600 may further include video memory (not shown) and a display device coupled to the video memory. Mass storage 618 and I/O ports 620 may couple to the bus 608. The hardware system 600 may optionally include a keyboard, a pointing device, and a display device (not shown) coupled to the bus 608. Collectively, these elements are intended to represent a broad category of computer hardware systems.

The elements of the hardware system 600 are described in greater detail below. In particular, the network interface 616 provides communication between the hardware system 600 and any of a wide range of networks, such as an Ethernet (e.g., IEEE 802.3) network, a backplane, or the like. The mass storage 618 provides permanent storage for the data and programming instructions to perform the above-described functions implemented in servers 522 of FIG. 10, whereas system memory 614 (e.g., DRAM) provides temporary storage for the data and programming instructions when executed by the processor 602. I/O ports 620 are one or more serial and/or parallel communication ports that provide communication between additional peripheral devices, which may be coupled to the hardware system 600.

The hardware system 600 may include a variety of system architectures, and various components of the hardware system 600 may be rearranged. For example, cache memory 604 may be on-chip with the processor 602. Alternatively, the cache memory 604 and the processor 602 may be packed together as a "processor module," with processor 602 being referred to as the "processor core." Furthermore, certain embodiments of the present disclosure may neither require nor include all of the above components. For example, the peripheral devices shown coupled to the standard I/O bus 608 may couple to the high performance I/O bus 606. In addition, in some embodiments, only a single bus may exist, with the components of the hardware system 600 being coupled to the single bus. Furthermore, the hardware system 600 may include additional components, such as additional processors, storage devices, or memories.

An operating system manages and controls the operation of the hardware system 600, including the input and output of data to and from software applications (not shown). The operating system provides an interface between the software applications being executed on the system and the hardware components of the system. Any suitable operating system may be used.

Furthermore, the above-described elements and operations may comprise instructions that are stored on non-transitory storage media. The instructions can be retrieved and executed by a processing system. Some examples of instructions are software, program code, and firmware. Some examples of non-transitory storage media are memory devices, tape, disks, integrated circuits, and servers. The instructions may be executed by the processing system to direct the processing system to operate in accord with the disclosure. The term "processing system" refers to a single processing device or a group of inter-operational processing devices. Some examples of processing devices are integrated circuits and logic circuitry. Those skilled in the art are familiar with instructions, computers, and storage media.

One or more features from any embodiment may be combined with one or more features of any other embodiment without departing from the scope of the disclosure.

A recitation of "a," "an," or "the" is intended to mean "one or more" unless specifically indicated to the contrary. In addition, it is to be understood that functional operations, such as "awarding," "locating," "permitting," and the like, are executed by game application logic that accesses, and/or causes changes to, various data attribute values maintained in a database or other memory.

The present disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend.

For example, the methods, game features and game mechanics described herein may be implemented using hardware components, software components, and/or any combination thereof. By way of example, while embodiments of the present disclosure have been described as operating in connection with a networking website, various embodiments of the present disclosure can be used in connection with any communications facility that supports web applications. Furthermore, in some embodiments, the term "web service" and "website" may be used interchangeably and, additionally, may refer to a custom or generalized API on a device, such as a mobile device (e.g., cellular phone, smart phone, personal GPS, personal digital assistance (PDA), personal gaming device, etc.), that makes API calls directly to a server. Still further, while the embodiments described above operate with business-related virtual objects (such as stores and restaurants), the embodiments can be applied to any in-game asset around which a harvest mechanic is implemented, such as a virtual stove, a plot of land, and the like. The specification and drawings are, accordingly, to be regarded in an illustrative rather than a restrictive sense. It will, however, be evident that various modifications and changes may be made thereunto without departing from the broader spirit and scope of the disclosure as set forth in the claims and that the disclosure is intended to cover all modifications and equivalents within the scope of the following claims.

What is claimed is:

1. A computer-implemented method comprising:

recording in a database a purchase value of a value icon in a virtual game;

using a virtual gaming system, deploying the value icon in a virtual environment of the virtual game, the value icon being a visual element displayed within the virtual environment, the value icon being receptive to player interaction by engagement with the visual element in the virtual environment; and for each of a plurality of reference time periods, monitoring interaction of a player of the virtual game with the value icon;

awarding a virtual currency amount to the player in response to satisfaction of an award condition comprising interaction by the player with the value icon at least a threshold number of instances during a respective one of the plurality of reference time periods, the virtual currency amount being recorded in the database; and denying the player further virtual currency based on subsequent interaction with the value icon, after the awarding of the virtual currency amount, during the respective one of the plurality of reference time periods.

2. The computer-implemented method of claim 1, comprising:

providing the player with a plurality of value icons;

monitoring a selection by the player of one of the plurality of value icons to identify a selected value icon; and updating the database of the virtual gaming system to include the selected value icon as the value icon deployed in the virtual environment of the player.

3. The computer-implemented method of claim 2, further comprising:

receiving an input from the player identifying a location in the virtual environment to locate the selected value icon in the virtual environment; and updating the virtual environment of the player to include the selected value icon at the location.

4. The computer-implemented method of claim 1, wherein the awarding of the virtual currency amount is limited to no more than a single award of the virtual currency amount during any particular one of the plurality of reference time periods.

5. The computer-implemented method of claim 1, wherein the virtual currency amount is a set amount that is the same for each reference time period.

6. The computer-implemented method of claim 1, wherein the virtual currency amount is different for at least two reference time periods.

7. The computer-implemented method of claim 1, comprising:

incrementing an interaction count in the database each time the player interacts with the value icon during each reference time period;

comparing the interaction count with a reference count; and denying further awarding of the virtual currency amount for the reference time period based on the comparing.

8. The computer-implemented method of claim 1, wherein the value icon depicts a tree or a bank building.

9. The computer-implemented method of claim 1, wherein the interaction with the value icon includes a mouse click or interaction with a touch screen of a mobile device.

10. The computer-implemented method of claim 1, wherein the virtual currency amount is redeemable in the virtual game to acquire further virtual objects.

11. The computer-implemented method of claim 1, wherein each reference time period is a multiple of a calendar day.

12. The computer-implemented method of claim 11, wherein each of the reference time periods is one calendar week.

13. The computer-implemented method of claim 1, further comprising displaying a message to another player in the event of the subsequent interaction by the player.

14. The computer-implemented method of claim 1, wherein the awarded virtual currency amount is not transferrable to another player in a social graph associated with the player.

15. The computer-implemented method of claim 1, further comprising:

accessing time information of a locale of a player device; and defining the plurality of reference time periods based on the date and time information.

16. A system comprising:

a recording module to record a purchase value of a value icon in a virtual game;

an update module to update a virtual environment of the virtual game to include the value icon, the value icon being a visual element displayable within the virtual environment and being receptive to player interaction;

a monitoring module implemented by at least one processor, the monitoring module configured to monitor, for each of a plurality of reference time periods, monitor interaction of a player of the virtual game with the value icon; and an award module configured to, for each of the plurality of reference time periods, award a virtual currency amount to the player when and only when the player interacts with the value icon at least a threshold number of instances during a respective one of the plurality of reference time periods, and deny the player further virtual currency based on subsequent interaction with the value icon, after the awarding of the virtual currency amount, during the respective one of the plurality of reference time periods.

17. The system of claim 16, comprising:

a value icon store to store a plurality of value icons;

a display module to provide the player with the plurality of value icons;

a selection module to monitor a selection by the player of one of the plurality of value icons to identify a selected value icon; and an update module to update the database of a virtual gaming system to include the selected value icon as the value icon deployed in the virtual environment of the player.

18. The system of claim 16, wherein an input is received from the player identifying a location in the virtual environment to locate the selected value icon; and the virtual environment of the player is updated to include the selected value icon.

19. The system of claim 16, wherein:

an interaction count is incremented in a database each time the player interacts with the value icon during a reference time period;

the interaction count is compared with a reference count; and further awarding of the virtual currency for the reference time period is denied based on the comparison.

20. A non-transitory computer-readable storage medium embodying instructions which, when executed by one or more processors, cause operations comprising:

recording in a database a purchase value of a value icon in a virtual game;

deploying the value icon in a virtual environment of the virtual game, the value icon being a visual element displayed within the virtual environment, the value icon being receptive to player interaction by engagement with the visual element in the virtual environment; and for each of a plurality of reference time periods, monitoring interaction of a player of the virtual game with the value icon;

awarding a virtual currency amount to the player in response to satisfaction of an award condition comprising interaction by the player with the value icon at least a threshold number of instances during a respective one of the plurality of reference time periods, the virtual currency amount being recorded in the database; and denying the player further virtual currency based on subsequent interaction with the value icon, after the awarding of the virtual currency amount, during the respective one of the plurality of reference time periods.

* * * * *

UNITED STATES PATENT AND TRADEMARK OFFICE

CERTIFICATE OF CORRECTION

PATENT NO. : 8,814,662 B1
APPLICATION NO. : 13/370809
DATED : August 26, 2014
INVENTOR(S) : Lall et al.

It is certified that error appears in the above-identified patent and that said Letters Patent is hereby corrected as shown below:

In the Drawings,

Sheet 8 of 11, Fig. 8, delete “265” and insert --365--, therefor

In the Specification,

In column 1, line 56, delete “environment:” and insert --environment;--, therefor In column 4, line 33, delete “imited” and insert --limited--, therefor In column 6, line 28, delete “transferrable” and insert --transferable--, therefor In column 13, line 20, delete “IN” and insert --$1_N$--, therefor In column 15, line 7, delete “interations” and insert --interactions--, therefor In column 16, line 45, delete “520b.” and insert --520b,--, therefor In the Claims, In column 20, line 59-60, in Claim 14, delete “transferrable” and insert --transferable--, therefor In column 21, line 33, in Claim 18, after “wherein”, insert --:--, therefor Signed and Sealed this
Twenty-third Day of December, 2014

Michelle K. Lee

Michelle K. Lee
*Deputy Director of the United States Patent and Trademark Office*